US006209736B1

(12) United States Patent
Chen et al.

(10) Patent No.: US 6,209,736 B1
(45) Date of Patent: Apr. 3, 2001

(54) STRUCTURE OF FEEDING BOTTLE

(76) Inventors: Pin-Nan Chen; Mei-Yen Cheng, both of No. 45 Ho-I Road, Keelung (TW)

( * ) Notice: Subject to any disclaimer, the term of this patent is extended or adjusted under 35 U.S.C. 154(b) by 0 days.

(21) Appl. No.: 09/327,479

(22) Filed: Jun. 8, 1999

(51) Int. Cl.[7] ..... A61J 9/04
(52) U.S. Cl. ..... 215/11.5; 215/11.1; 215/902
(58) Field of Search ..... 215/11.1, 11.4, 215/11.5, 902

(56) References Cited

U.S. PATENT DOCUMENTS

| | | | | |
|---|---|---|---|---|
| 458,906 | * | 9/1891 | Jordan | 215/11.5 X |
| 1,080,070 | * | 12/1913 | Mambourg | 215/11.5 |
| 2,394,722 | * | 2/1946 | Sloane | 215/11.5 |
| 3,134,495 | * | 5/1964 | Carbonel | 215/11.4 |
| 4,401,224 | * | 8/1983 | Alonso | 215/11.5 |
| 4,685,577 | * | 8/1987 | Chen | 215/11.5 |
| 4,723,668 | * | 2/1988 | Cheng | 215/11.5 |
| 4,821,896 | * | 4/1989 | Cheng | 215/11.5 X |
| 5,431,290 | * | 7/1995 | Vinciguerra | 215/11.5 |
| 5,474,028 | * | 12/1995 | Larson et al. | 215/11.1 X |
| 5,499,729 | * | 3/1996 | Greenwood et al. | 215/11.5 |

FOREIGN PATENT DOCUMENTS

| | | | | |
|---|---|---|---|---|
| 860757 | * | 1/1971 | (CA) | 215/11.1 |
| 295183 | * | 8/1928 | (GB) | 215/11.1 |
| 324194 | * | 1/1930 | (GB) | 215/11.1 |
| 2139903 | * | 11/1984 | (GB) | 215/11.1 |

* cited by examiner

*Primary Examiner*—Sue A. Weaver
(74) *Attorney, Agent, or Firm*—Bacon & Thomas, PLLC

(57) ABSTRACT

An improved structure of feeding bottle is composed of a bottle main body, a hard ferrule, a silicon gel ventilative gasket, and a bottom closure. A thoroughly opened bottom opening formed at bottom end of the bottle main body is covered with the hard ferrule and the ventilative gasket one after the other, then sealed by swiveling the bottom closure. A through hole and a vent are formed in the hard ferrule and in the bottom closure respectively. One or at least one protrusion is disposed on the ventilative gasket within confines of the through hole in the hard ferrule, wherein a slot or cross cut is formed in top face of the protrusion. By means of packing effect of the hard ferrule, the ventilative gasket can attach to the bottom closure without detaching from the bottom opening for providing an easy-cleaning, leakage-proof, and convenient feeding bottle.

9 Claims, 4 Drawing Sheets

STRUCTURE OF FEEDING BOTTLE

BACKGROUND OF THE INVENTION

1. Field of the Invention

This invention relates to an improved structure of feeding bottle, particularly to a feeding bottle that is provided with a thoroughly opened bottom opening for easy cleaning, a hard ferrule to pack a ventilative gasket and prevent it from detaching to keep the feeding bottle always in normal operation.

2. Description of the Prior Art

A conventional structure of feeding bottle has been disclosed in U.S. Pat. No. 4,723,668, wherein a flexible ventilative gasket is disposed to bottom of a feeding bottle, and a crossed cut is made in the ventilative gasket. When an infant is sucking milk, the air in the bottle will flow out of the bottle accompanying the milk, so that the air pressure in the bottle is decreased, and outside air will flow into the bottle to balance the air pressure inside and outside. The defect is that the small inward-shrinking crossed cut in bottle bottom may curb the cleaning job.

In another U.S. Pat. No. 57694, a ventilative gasket used to cover on bottom opening of a bottomless feeding bottle is locked by a swivel bottom closure. This disclosure can facilitate cleaning on the one hand all right, however, a ventilative gasket disposed to the bottle bottom is packed only by a small ring area of the bottle wall in 0.2 cm thick that can hardly pack the ventilative gasket on the other hand. Hence, in the case when relatively stronger sucking force is required, such as feeding an eider infant or feeding with thicker juice or the like, the ventilative gasket may be deformed to bulge like a semi-sphere or even detached from the bottle bottom to result in leakage or become functional disabled.

As disclosed in Japan patent No. 120285, an inward-shrinking opening is also formed in bottle bottom with an extra narrow packing ring in 0.2 cm thick for constraining a ventilative gasket. The defect of this disclosure is about the same with that in abovesaid U.S. Pat. No. 57694 for lack of a leakage-proof function.

Another U.S. Pat. No. 14739 is to perforate a small vent in bottle bottom with a ventilative structure plugged therein that makes cleaning job uneasy, then seal the vent with a bottom closure. The plug introduces another problem—if the plug is made of the same hard material with the bottle body, the combining edge cannot completely sealed, and on the contrary, a clearance will comes out when a relatively hotter liquid is loaded in the bottle due to different expansion coefficients of the plug and the bottle body to cause leakage; and further, after the bottle is sterilized in high temperature, the structure will be deformed and damaged permanently.

Similarly, a further U.S. Pat. No. 2,139,903 is to form small vent in bottle bottom or in bottle wall and use a vertilative plug to seal the small vent that incurs a defect as abovesaid U.S. Pat. No. 14739 has done.

Furthermore, a U.S. Pat. No. 3,134,495 with a complicated structure in relatively higher cost is also to open a inward-shrinking opening in bottle bottom that curbs cleaning job as mentioned above. In addition, according to its illustrating diagrams, when the bottle is filled up with milk, the center of gravity will locate at an upper position to set the feeding bottle in an unstable state.

SUMMARY OF THE INVENTION

This invention is proposed to provide a structure of feeding bottle, which contains a bottomless cylindrical bottle body for easy cleaning to assure safety in feeding an infant.

Another object of this invention is to provide a rigid and durable structure of feeding bottle, wherein a hard ferrule with large ring area is used to pack a ventilative gasket to keep the latter stuck to a bottom closure without detachment to assure normal function of the feeding bottle.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
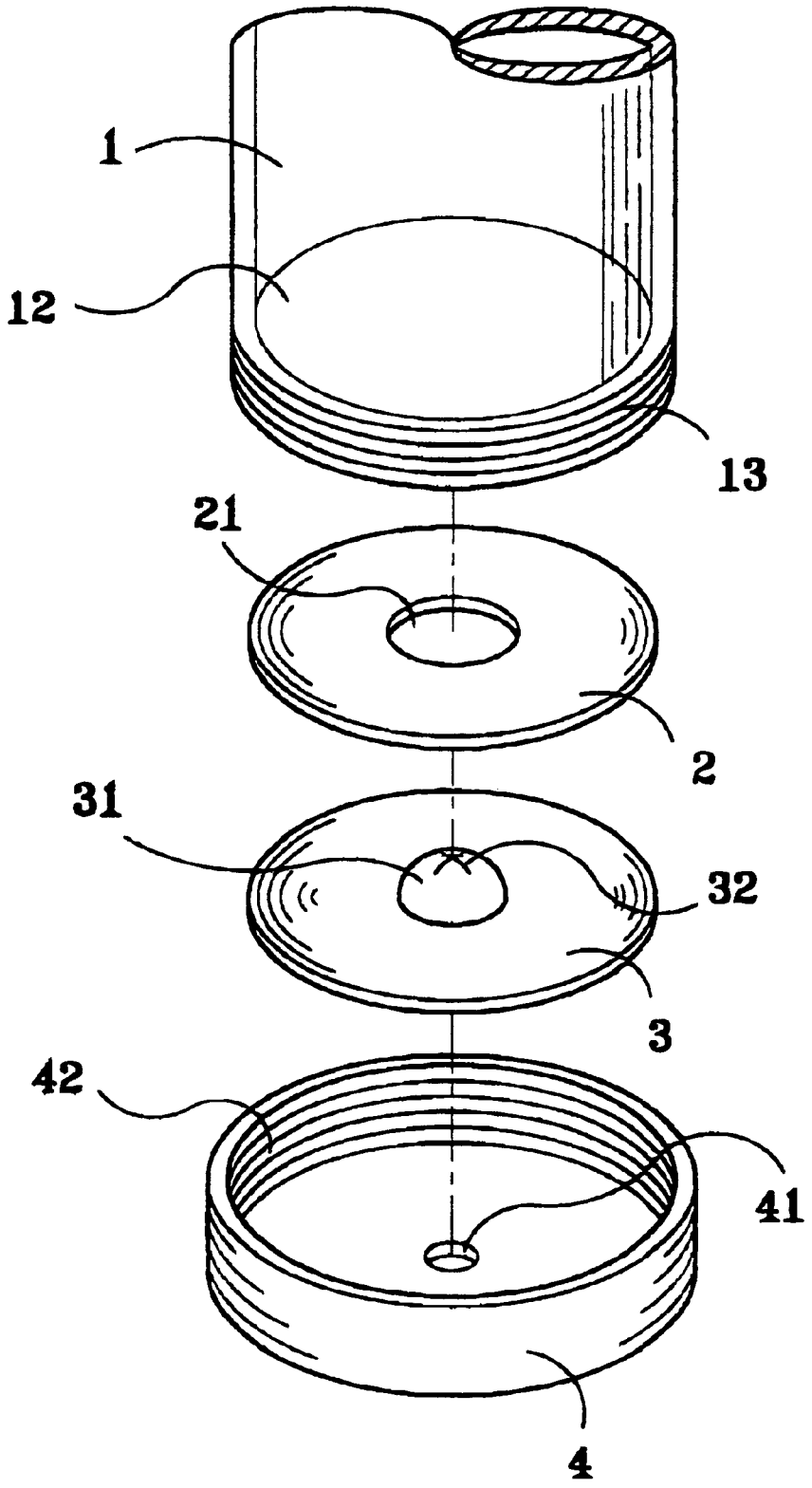
FIG. 1 is a three-dimensional exploded top view showing an improved structure of feeding bottle of this invention.
Figure 2:
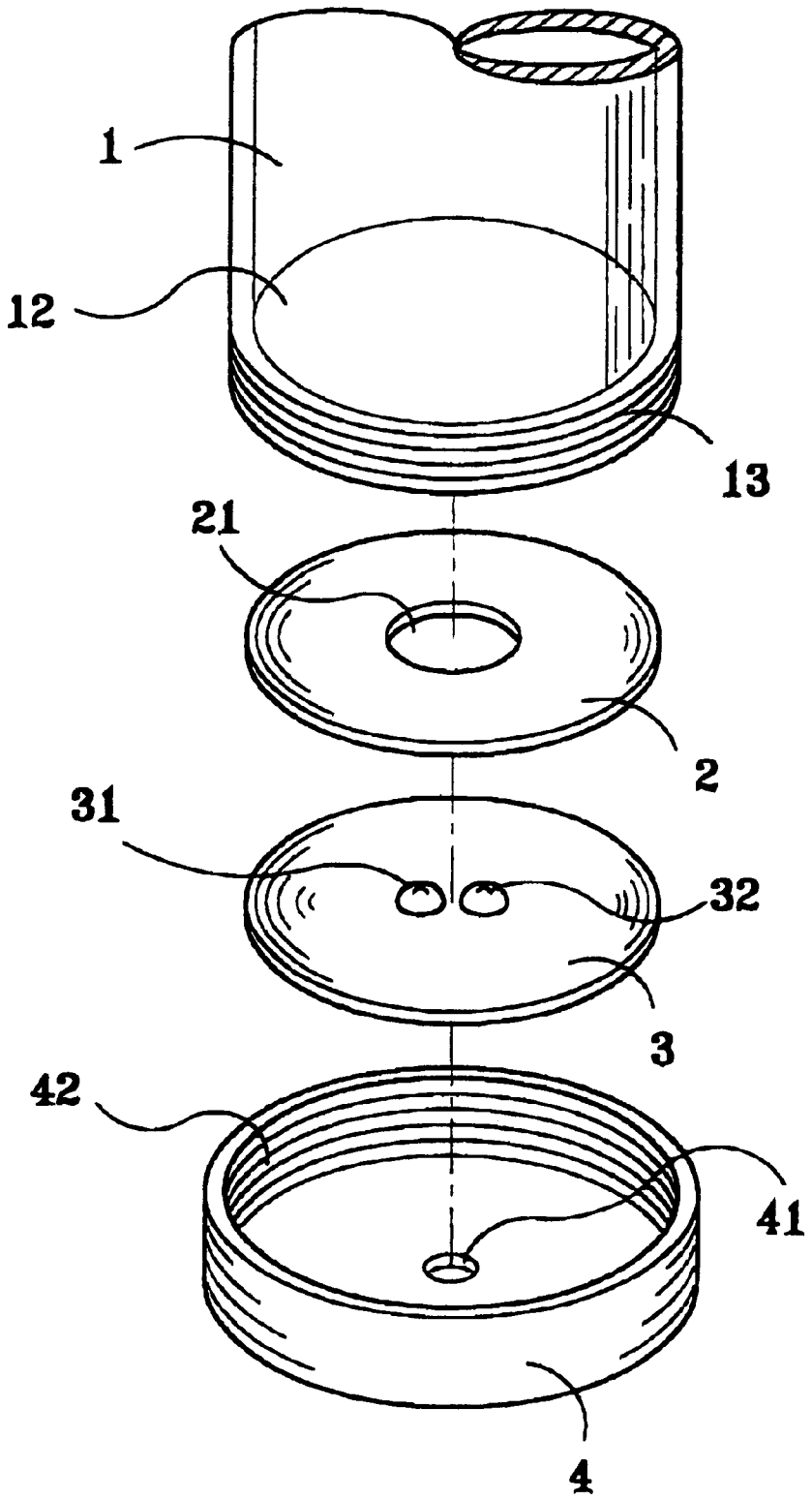
FIG. 2 is a schematic view of another embodiment of the improved structure of this invention.

As shown in FIGS. 1 and 2, an improved structure of feeding bottle of this invention comprises a bottle main body 1, a hard ferrule 2, a ventilative gasket 3, and a bottom closure 4. The bottle main body 1 is a cylindrical vessel with two thoroughly opened ends, wherein the top end is used to unite with a conventional nipple 11, the bottom end is a bottom opening 12 having an diameter coincident with inner diameter of the bottle main body 1 to facilitate cleaning the bottle. A male-threaded external coupling face 13 is formed on outer-ring surface of the bottom opening 12 in the bottle main body 1 for locking with the bottom closure 4. A through hole 21 in circle or in an arbitrary polygon is positioned in center of the hard ferrule 2, which is to be inserted in and from beneath the bottom opening 12. The ventilative gasket 3 located under the hard ferrule 2 is made of silicon rubber or other flexible material and is provided with at least a protrusion 31 having single slot or crossed cut 32 on its top for ventilation, which, the protrusion 31, stretches its head into the chamber of the bottle main body 1 through the opening 21. The bottom closure 4 disposed under the ventilative gasket 3 having a vent 41 for air ventilation, wherein a female-threaded internal coupling face 42 is formed on inner-ring face of the bottom closure 4 for combining with the external coupling face 13 to lock the bottom closure 4 on bottom end of the bottle main body 1.

Figure 3:
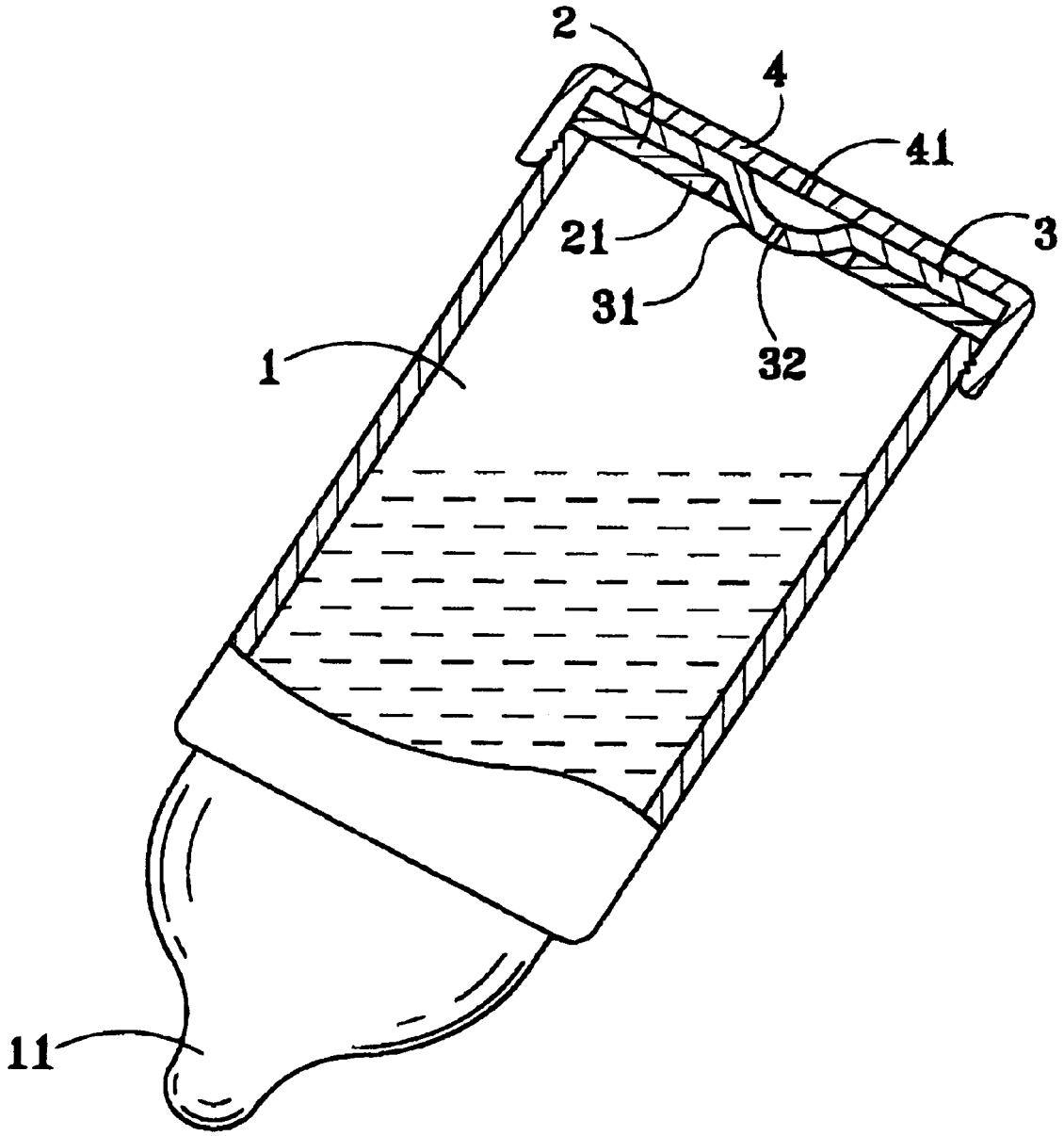
FIG. 3 is a cutaway sectional view of the improved structure of this invention.
Figure 4A:
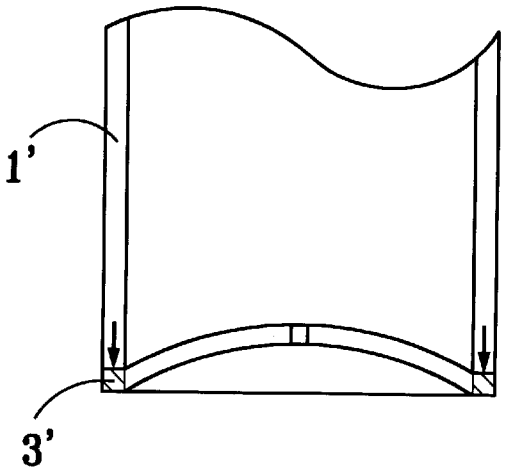
PRIOR ART FIG. 4A
FIG. 4A illustrates a disposition example of a ventilation gasket of a conventional feeding bottle.
Figure 4B:
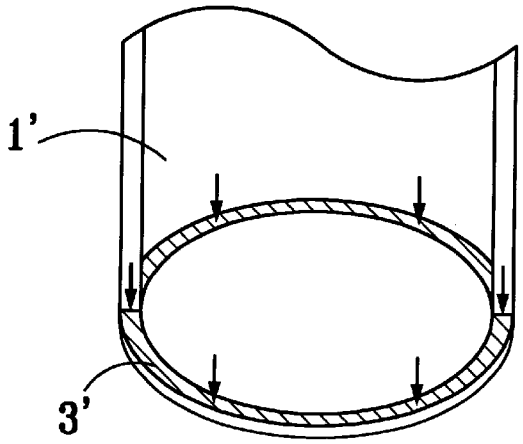
PRIOR ART FIG. 4B
FIG. 4B is a schematic view of pressure distribution on the ventilation gasket in the conventional feeding bottle.
Figure 5A:
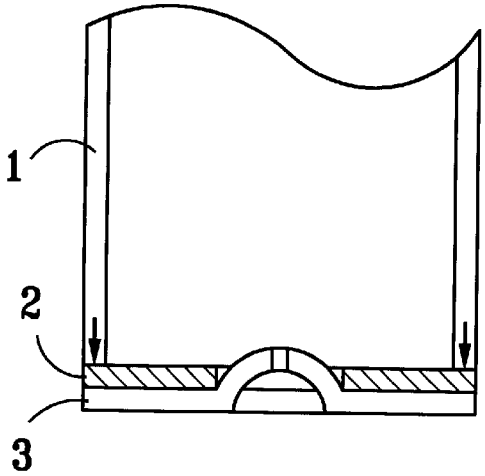
FIG. 5A illustrates a disposition example of a ventilation gasket of this invention.
Figure 5B:
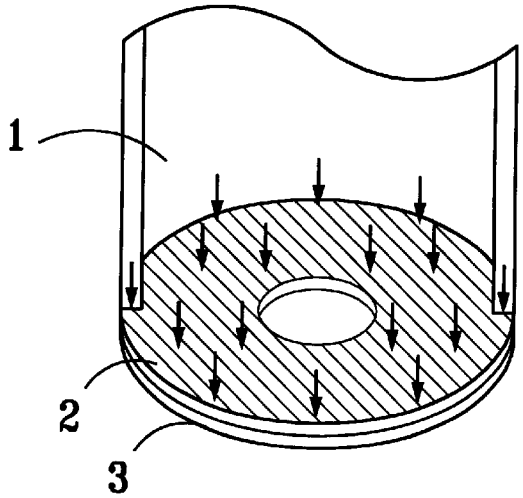
FIG. 5B is a schematic view of pressure distribution on the ventilative gasket of this invention.

Referring to FIG. 3, when an infant is sucking at the nipple 11, the air dissolved in the milk will flow out accompanying the milk to result in decreasing the air pressure in the bottle main body 1, so that outside air will flow into the bottle main body 1 for replenishment through the vent 41 and the slot or crossed cut 32 to balance the internal and the external air pressure. In the case of an elder infant or a relatively thicker juice or the like loaded in the bottle main body 1, the soft ventilative gasket 3 will probably bulge and form a semi-sphere owing to the stronger sucking force if lack of the hard ferrule 2 that is capable of packing a large ring area of the ventilative gasket 3 and preventing it from being deformed to maintain the same in a normal functional state.

As shown in FIGS. 4A through 5B, in comparison this invention with aforementioned conventional feeding bottles (U.S. Pat. No. 57694 or Japan patent No. 120285), the common ventilative gasket 3' in the cited patents is confined at bottom end of the bottle main body 1' merely in a narrow ring realm as mentioned above, and as foregoing described, the wall thickness of the bottle main body 1' is only about 0.2 cm that can hardly pack the ventilative gasket 3 effectively. On the other hand, this invention provides an extra hard ferrule 2 with wide ring area sitting on the ventilative gasket 3 that can assure the latter to stick firmly in the bottle end without detachment for achieving purpose of leakage-proof.

By means of above construction, this invention can obviously provide an improved structure of an easy-cleaning feeding bottle for protecting feeding safety of the infant and assuring normal function as well as elongating lifetime of a feeding bottle.

Although, this invention has been described in terms of preferred embodiments, it is apparent that numerous variations and modifications may be made without departing from the true spirit and scope thereof, as set forth in the following claims.

What is claimed is:

1. An improved structure for a feeding bottle, comprising:

a bottle main body with a thoroughly opened bottom opening, wherein an external coupling face is disposed on outer lateral surface of said bottle main body around said bottom opening;

a hard ferrule covering said bottom opening, wherein a through hole is formed in said hard ferrule;

a ventilative gasket disposed beneath said hard ferrule, wherein said ventilative gasket is provided with a protrusion penetrating said through hole in said hard ferrule, and a slit cut is formed in top face of said protrusion;

a bottom closure disposed under said ventilative gasket for fixing said hard ferrule and said ventilative gasket to the bottom opening of said bottle main body, wherein an internal coupling face is formed in inner wall of said bottom closure for combining with said external coupling face to lock said bottom closure to said bottle main body; and wherein a vent is formed in said bottom closure.

2. The improved structure for a feeding bottle of claim 1, wherein said ventilative gasket includes at least two of the protrusions.

3. The improved structure for a feeding bottle of claim 2, wherein a shape of the slit cut of said protrusion is selected from the group consisting of a slot or a cross.

4. The improved structure for a feeding bottle of claim 1, wherein a shape of the slit cut of said protrusion is selected from the group consisting of a slot or a cross.

5. The improved structure for a feeding bottle of claim 1, wherein said external and said internal coupling face are threaded for locking each other.

6. The improved structure for a feeding bottle of claim 1, wherein said through hole in said hard ferrule is circular.

7. The improved structure for a feeding bottle of claim 1, wherein said ventilative gasket is made of a flexible material for sealing said bottom opening of said bottle main body efficiently.

8. The improved structure for a feeding bottle of claim 7 wherein said flexible material is silicone rubber.

9. The improved structure for a feeding bottle of claim 1 wherein a height of said protrusion extending past an opening of the through hole and into the bottle body is less than a length of the through hole.

* * * * *